US009243878B2

(12) United States Patent
Martin

(10) Patent No.: US 9,243,878 B2
(45) Date of Patent: Jan. 26, 2016

(54) BOREHOLE PLUG INFLATION CONTROL

(75) Inventor: Michael John Martin, Queensland (AU)

(73) Assignee: Crinum IP Pty Ltd, Queensland (AU)

( * ) Notice: Subject to any disclaimer, the term of this patent is extended or adjusted under 35 U.S.C. 154(b) by 111 days.

(21) Appl. No.: 13/980,572

(22) PCT Filed: Jan. 20, 2012

(86) PCT No.: PCT/AU2012/000046

§ 371 (c)(1),
(2), (4) Date: Oct. 1, 2013

(87) PCT Pub. No.: WO2012/097415

PCT Pub. Date: Jul. 26, 2012

(65) Prior Publication Data

US 2014/0013984 A1 Jan. 16, 2014

(30) Foreign Application Priority Data

Jan. 20, 2011 (AU) ..... 2011900182

(51) Int. Cl.
*F42D 1/18* (2006.01)
*E21B 33/127* (2006.01)
*E21B 33/128* (2006.01)

(52) U.S. Cl.
CPC ..... *F42D 1/18* (2013.01); *E21B 33/1277* (2013.01); *E21B 33/1285* (2013.01)

(58) Field of Classification Search
CPC ..... E21B 33/12; E21B 33/134; F42D 1/18; F42D 1/22
USPC ..... 102/313, 333
See application file for complete search history.

(56) References Cited

U.S. PATENT DOCUMENTS 3,098,442 A * 7/1963 Wakefield et al. ..... 102/330
5,346,005 A * 9/1994 Robbins ..... 166/187
6,302,202 B1 * 10/2001 Moore ..... 166/187

FOREIGN PATENT DOCUMENTS

AU 199942454 3/2000
AU 200010114 7/2000
AU 200111113 7/2001
AU 200126422 9/2001

OTHER PUBLICATIONS

International Preliminary Report on Patentability for PCT/AU2012/000046 mailed Jul. 23, 2013.
Australian Patent Office International-Type Search Report for National Application No. 2011900182 mailed May 20, 2011.
International Search Report for PCT/AU2012/000046 mailed Feb. 27, 2012.

* cited by examiner

*Primary Examiner* — Stephen M Johnson
*Assistant Examiner* — Benjamin Gomberg
(74) *Attorney, Agent, or Firm* — McDonnell Boehnen Hulbert & Berghoff LLP

(57) ABSTRACT

An inflatable borehole plug comprising an inflatable fluid tight bag with a storage container containing an inflation fluid in a compressed state located within the fluid tight bag. The storage container has a first actuator and a second actuator located at opposite ends thereof to initiate release of inflation fluid and hence effect expansion of the fluid tight bag. Choice of the vertical orientation of the first and second actuators and of which or both are activated provides differing rates of release of the inflation fluid and corresponding different rates of inflation of the fluid tight bag.

20 Claims, 2 Drawing Sheets

BOREHOLE PLUG INFLATION CONTROL

CROSS REFERENCE TO RELATED APPLICATIONS

The present application is a 35 U.S.C. 371 National Application of PCT/AU2012/000046, filed Jan. 20, 2012, which claims priority to Australian Patent Application No. 2011900182, filed Jan. 20, 2011.

FIELD OF THE INVENTION

The present invention relates to an apparatus and method for inflation of a borehole plug. More particularly, the present invention relates to an apparatus and method providing for control of the inflation rate of a borehole plug.

BACKGROUND OF THE INVENTION

Expandable borehole plugs are generally employed to form a support or "deck" within an explosives borehole to support a column of explosive composition thereabove. Selective placement of one or more borehole plugs in a borehole enables selective concentration of explosive energy in one or more regions along the length of the borehole.

Inflatable borehole plugs usually comprise a sealed gas tight flexible bag containing a source of pressurized fluid which source, when actuated has a time delay property to enable the flexible bag to be lowered into a borehole to a predetermined depth before expanding against the borehole wall to form a deck.

Typically the source of pressurized fluid comprises an aerosol canister with a conventional valve stem and a mechanical actuator which, when actuated, holds the valve in an open position to discharge the entire contents of the canister in a manner similar to insecticide "bombs" or other aerosol fumigants.

The aerosol canister may contain a quantity of a non-expansive liquid, such as water, and a quantity of an expansive propellant, such as a hydrocarbon or halohydrocarbon, which remain in separate phases with the water at the bottom of the can and the propellant in a gas/liquid space thereabove. Alternatively, the canister may contain only a standard expandable fluid.

A dip tube or stem extends from the interior inlet port of the valve to open adjacent the base of the aerosol canister and, when actuated, water, if present, is discharged first and when substantially all of the water volume is discharged, the propellant gas is then discharged. In this manner, the water acts as a time delay fluid enabling the inflatable borehole plug to be lowered to a predetermined depth in a borehole before the propellant gas enters the flexible bag body of the plug to expand the body against the borehole wall.

The period of time delay can be as much as 5 minutes and is influenced by the volume of water in the aerosol can and/or the diameter of the discharge orifice in the valve and/or actuating cap.

Expandable borehole plugs or modified forms thereof are described in Australian Patent 763474 and Australian Patent 779463, the disclosures of which are incorporated herein by reference.

There are limitations to the control over inflation delay which can be exerted purely by means of the inflation fluid composition. Further, in many cases the time delay effected by the inflation fluid is greatly in excess of the time required to place the borehole plug at the desired depth in the borehole. This excess time is inefficient and a waste of skilled labour hours. It would be valuable to provide for a further control mechanism over the inflation process and, particularly, allow the process to be sped up, when required, without requiring a range of inflation fluid compositions be provided, tailor made for different depth applications.

OBJECT OF THE INVENTION

It is an object of the invention to overcome or alleviate one or more of the above disadvantages or to provide the consumer with a useful or commercial choice.

SUMMARY OF THE INVENTION

In one broad form, the invention resides in an inflatable borehole plug comprising an inflatable fluid tight bag, a storage container comprising an inflation fluid, the storage container located within the fluid tight bag, and the storage container having a first fluid release valve and a second fluid release valve located at opposing ends thereof.

According to one form, although not necessarily the only or broadest form the invention resides in an inflatable borehole plug comprising:

(a) an inflatable fluid tight bag;

(b) a storage container located within the fluid tight bag, the storage container containing an inflation fluid in a compressed state and having a first actuator located on a first end thereof and a second actuator located on a second end thereof; and wherein, the first actuator is associated with a first release valve and the second actuator is associated with a second release valve, said first and second release valves actuable to allow inflation fluid to pass therethrough and effect expansion of the fluid tight bag.

Preferably, the first release valve is in fluid communication with an elongate dip tube, the dip tube extending into and having an open end in fluid communication with, an interior of the storage container.

Suitably, when the storage container is oriented such that the first actuator is positioned vertically above the second actuator, the dip tube extends into the interior of the storage container such that its open end is immersed in a liquid portion of the inflation fluid.

Preferably, the dip tube extends into the interior of the storage container such that its open end is located closer to the second end of the storage container than to the first end.

More preferably, the dip tube extends into the interior of the storage container such that its open end is substantially adjacent the second end of the storage container.

Preferably, the second release valve does not have an associated elongate dip tube which extends substantially into the interior of the storage container.

Suitably, the first and second ends of the storage container are located opposite one another.

The fluid tight bag may be enclosed within a protective outer bag.

Preferably, the fluid tight bag is folded over within the outer bag.

The fluid tight bag may be folded over along a line more than halfway, preferably approximately five eights, along its length.

According to another aspect of the invention there is provided a method of controlling the rate of inflation of an inflatable borehole plug including the steps of:

(a) providing an inflatable fluid tight bag having a storage container located therein, the storage container containing an inflation fluid in a compressed state and the storage container having a first actuator and a second actuator for release of the inflation fluid into the fluid tight bag; and (b) choosing to activate one or both of the first actuator and the second actuator to thereby control the rate of inflation of the borehole plug.

Suitably, the method is performed using the inflatable borehole plug as herein described.

Preferably, the method of controlling the rate of inflation of the inflatable borehole plug provides for at least two differing inflation rates.

More preferably, the method of controlling the rate of inflation of the inflatable borehole plug provides for at least four differing inflation rates.

The method may further include the step of orienting the storage container in a substantially vertical position prior to activation such that either the first actuator or second actuator is located uppermost with respect to the other to provide access to differing rates of inflation.

Preferably, the storage container is oriented such that one of the first actuator or the second actuator is positioned substantially directly vertically above the other.

The method may further include the step of orienting the storage container such that the first actuator is uppermost and activating both the first and second actuators to thereby achieve a first rate of inflation.

The method may further include the step of orienting the storage container such that the first actuator is uppermost and activating one of the first actuator or the second actuator to thereby achieve a second rate of inflation wherein the first rate of inflation is faster than the second rate of inflation.

The method may further include the step of orienting the storage container such that the second actuator is uppermost and activating both the first and second actuators to thereby achieve a third rate of inflation wherein the second rate of inflation is faster than the third rate of inflation.

The method may further include the step of orienting the storage container such that the second actuator is uppermost and activating one of the first actuator or the second actuator to thereby achieve a fourth rate of inflation wherein the third rate of inflation is faster than the fourth rate of inflation.

The method may further include the step of enclosing the fluid tight bag within a protective outer bag.

The method may further include the step of folding the fluid tight bag prior to its enclosure within the outer bag.

According to another aspect of the invention there is provided a method of locating a borehole plug at a desired depth in a borehole including the steps of:

(a) providing an inflatable fluid tight bag having a storage container located therein, the storage container containing an inflation fluid in a compressed state and having a first actuator and a second actuator for release of the inflation fluid into the fluid tight bag;

(b) vertically orienting the storage container such that either of the first actuator or the second actuator is uppermost relative to the other;

(c) activating one or both of the first actuator and the second actuator to release the inflation fluid and initiate inflation of the fluid tight bag;

(d) locating the fluid tight bag at the desired depth in the borehole;

(e) maintaining the fluid tight bag at the desired depth in the borehole until the fluid tight bag inflates to a sufficient degree to engage with the walls of the borehole; and wherein, the selection of which of the first actuator or second actuator are vertically uppermost and which or both are activated determines the rate of inflation of the fluid tight bag.

Further features of the present invention will become apparent from the following detailed description.

Throughout this specification, unless the context requires otherwise, the words "comprise", "comprises" and "comprising" will be understood to imply the inclusion of a stated integer or group of integers but not the exclusion of any other integer or group of integers.

BRIEF DESCRIPTION OF THE FIGURES

In order that the invention may be readily understood and put into practical effect, preferred embodiments will now be described by way of example with reference to the accompanying figures wherein like reference numerals refer to like parts and wherein.

DETAILED DESCRIPTION OF THE INVENTION

Figure 1:
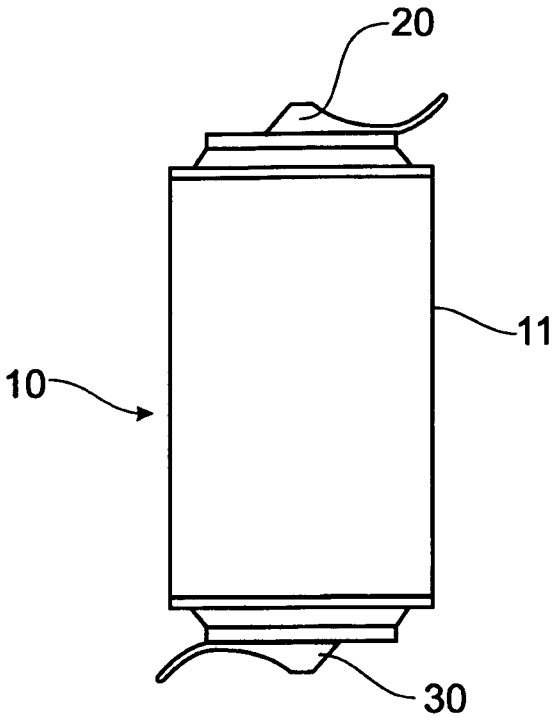
FIG. 1 is an embodiment of a storage container suitable for use in the present invention.

FIG. 1 is an embodiment of a storage container 10 suitable for use in the present invention. Storage container 10 comprises an outer wall 11 which, in the embodiment shown, forms a cylinder although other shapes may also be suitable. Storage container 10 comprises a first actuator 20 located on a first end of storage container 10 and a second actuator 30 located at a second end of storage container 10. The first and second ends are therefore, in the embodiment shown, located at opposite ends of storage container 10.

Storage container 10 may be of the type that is known in the art of pressure cans or sprays that are commonly used to deliver materials by action of a propellant expanding through a nozzle with the exception that it is actuable at both ends rather than one end only, as is standard in the prior art. First and second actuators, 20 and 30 respectively, are also, individually, of a standard design for pressurised canisters and would be well known in the art.

Typically, an activator such as a press button is provided on both actuators 20 and 30 by which the storage container 10 is able to be triggered in the field to deliver its expansive fluid into a borehole plug and inflate it. A variety of mechanisms might be used to seal or hold the expansive fluid in storage container 10 until its release is to be effected. Release might be effected by a twist action seal, by the breaking of an elongate seal, by the depression of a valve activator, as will be known to those skilled in the art of storing gases under pressure in pressure cans and the like. Preferably, release is by activation of a one shot trigger.

A one shot trigger is readily arranged by fitting a latch to the activation mechanism, operative to hold the activation mechanism in an activated state once it has been activated. This might be effected by a push button or lever that depresses the usual aerosol can valve outlet, the push button or lever being fitted with a locking lip, hook, latch or the like, as will be familiar to mechanical engineers.

In this manner, once either or both of first and second actuators, 20 and 30 respectively, are activated they will dispense pressurised fluid from the interior of storage container 10 until it has substantially all been expended.

The inflation fluid may be selected from a wide range of well known examples including hydrocarbon fluids. A preferred inflation fluid composition for the present invention may be a dimethyl ether (DME), water and alcohol mixture. The majority of the mixture may be water with a relatively small amount of alcohol sufficient only to solubilise the DME, being the remainder of the formulation, in the water. Such a formulation may also comprise amounts of flourohydrocarbons such as 1,1,1,2-tetrafluoroethane (product name R134a) or, preferably, trans-1,3,3,3-tetrafluoroprop-1-ene (product name HFO-1234ze).

Figure 2:
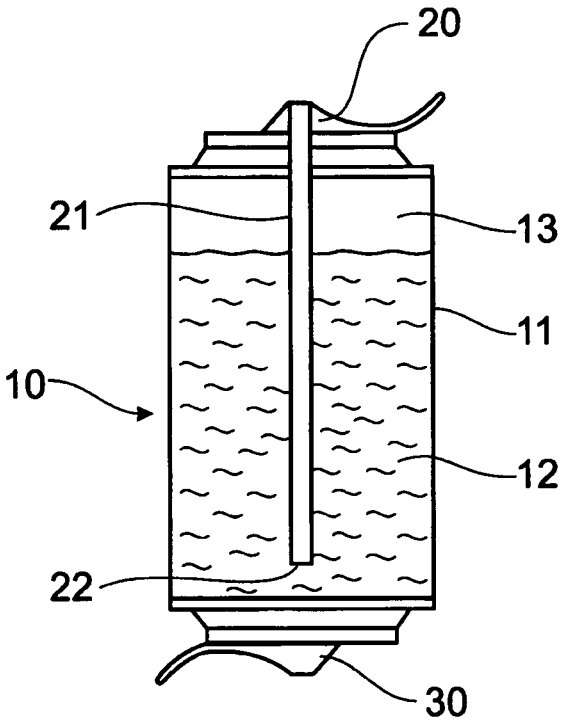
FIG. 2 shows the storage container of FIG. 1 in a partial sectional view such that the interior of the canister can be viewed.

FIG. 2 shows storage container 10 of FIG. 1 in a partial sectional view such that the interior of storage container 10 can be viewed. It can be seen that storage container 10 contains a quantity of an inflation fluid 12 sufficient to fully inflate an associated borehole plug such that it will engage with the walls of a borehole to provide an explosives decking means. The interior chamber of storage container 10 is not entirely filled with inflation fluid 12 in liquid form, as would typically be the case with canisters of pressurised fluid, and so a head space 13 is present above the liquid inflation fluid 12. At least some of inflation fluid 12 will be present in headspace 13 as a vapour.

The inner workings of a first release valve associated with first actuator 20 and a second release valve associated with second actuator 30 have not been shown since they are generally of a standard design but it is apparent that the first release valve of first actuator 20 has an attached elongate stem or dip tube 21 which is in fluid communication therewith. Dip tube 21 has an open end 22 and can be seen to extend into the interior of storage container 10 and, preferably, is immersed within the liquid portion of inflation fluid 12 when storage container 10 is positioned in the vertically upright position shown in FIG. 2 with first actuator 20 uppermost.

It is further preferred that dip tube 21 extends to be close to the second end of storage container 10 on which second actuator 30 is located. That is, the elongate stem or dip tube 21 associated with the release valve of first actuator 20 has its open end closer to the second end of storage container 10 than the first end. Preferably, dip tube 21 has its open end 22 substantially adjacent the second end of storage container 10.

Dip tube 21 allows for inflation fluid 12 to enter its hollow interior through open end 22, upon activation of first actuator 20, and pass along its length to then exit storage container 10 through the first release valve of first actuator 20. The design of dip tube 21 is thus standard and would be well known to those skilled in the art of containing and releasing pressurised fluids.

It can be seen from FIG. 2, however, that in the preferred embodiment shown, the second release valve associated with second actuator 30 is not provided with a stem or dip tube equivalent to that shown extending from the first release valve associated with first actuator 20 i.e. one which extends substantially into the interior of the storage container 10. Since second actuator 30 is shown, in this orientation, to be on the bottom of storage container 10, i.e. vertically below first actuator 20, inflation fluid 12 is in direct contact and in fluid communication with the second release valve and so activation of second actuator 30 would result in liquid inflation fluid 12 being immediately expelled therefrom.

It will be appreciated that the second actuator may have a very short stem or dip tube or at least a tubular opening connected thereto to facilitate entry and expulsion of inflation fluid 12 therefrom but, at least in preferred embodiments, the opening of such a dip tube or stem would be closer to the second end than the first end of storage container 10. Preferably, any dip tube or stem associated with the second release valve would have its open end substantially adjacent the second end of storage container 30.

The embodiment shown in FIG. 2, in the particular orientation shown i.e. with first actuator 20 positioned to be vertically above second actuator 30, potentially allows for three different rates of inflation of an associated borehole plug. Firstly, a user may activate only first actuator 20 and so inflation fluid 12 will almost immediately begin to be expelled since open end 22 of dip tube 21 is immersed in said inflation fluid 12. This would result in a typical inflation rate achieved with standard commercially available inflatable borehole plugs since most prior art borehole plugs would have a pressurised container with a single actuator and dip tube or stem similar to that described for first actuator 20.

However, if a faster rate of inflation of the borehole plug is required then both first actuator 20 and second actuator 30 may be activated, preferably at approximately the same time. This will result in the liquid portion of inflation fluid 12 being released through the first release valve of first actuator 20, as just described, but would also allow expulsion of liquid inflation fluid 12 through the second release valve associated with second actuator 30, simultaneously, thereby providing for a faster rate of release of inflation fluid 12 and a corresponding faster overall inflation rate of an associated borehole plug. This approach would be appropriate if the borehole plug, containing storage container 10, was being located only a relatively short distance down a borehole. The faster inflation rate means that man hours are not wasted by requiring a user to hold the borehole plug at the desired level within the borehole until it engages with the borehole walls by inflating at a rate achieved by expulsion through only one actuator. The faster rate of expulsion achieved by activation of both first and second actuators, 20 and 30 respectively, means the inflated borehole plug will engage with the borehole wall much sooner and so, when placing the borehole plug at relatively low depths, less time is wasted.

Finally, a user may only activate second actuator 30 and so inflation fluid 12 will be expelled only through the associated second release valve. In practice this release rate would be relatively similar to that achieved by activation of first actuator 20 alone and so, in terms of practically useful differing rates, the embodiment and orientation of storage container 10 shown in FIG. 2 provides for two quite separate and relatively fast rates of release of inflation fluid 12 from storage container 10, and hence, rates of inflation of an associated borehole plug.

The activation of both first and second actuators, 20 and 30 respectively, as described with the first actuator 20 vertically uppermost will result in a first rate of release of inflation fluid 12 and a corresponding first rate of inflation of the associated borehole plug which is the maximum rate of release/inflation which can be achieved by storage container 10. It will be appreciated that the final rate of release/inflation will be effected by considerations such as the actual size/volume of the borehole plug to be inflated, external temperature, inflation fluid 12 composition and volume and the final pressure inside the storage container 10 but, in one general embodiment for a bag with approximate dimensions of 585 mm by 500 mm, the first rate of inflation is between 10 to 20 seconds, preferably about 15 seconds for the preferred inflation composition of 24% DME, water and a small amount of IPA as described earlier. The term "rate of inflation" refers to the time taken for the borehole plug to become inflated to such an extent that it engages with the borehole walls to a sufficient extent to support its own weight i.e. to securely lodge there.

The activation of only the first actuator 20 (or only the second actuator 30) when the first actuator 20 is vertically uppermost as shown in FIG. 2, will result in a second rate of release of inflation fluid 12 and a corresponding second rate inflation of the associated borehole plug. The second rate of release/inflation will be slower than the first rate of release/inflation and may be between 20 to 35 seconds, preferably about 25 seconds for a bag with dimensions as described above. Although the times for various inflation rates given herein are only a guide it will be appreciated that a noticeable difference is provided by the choice of activation of both or only one of the first and second actuators 20 and 30 to achieve either the first of the second rate of release/inflation.

Figure 3:
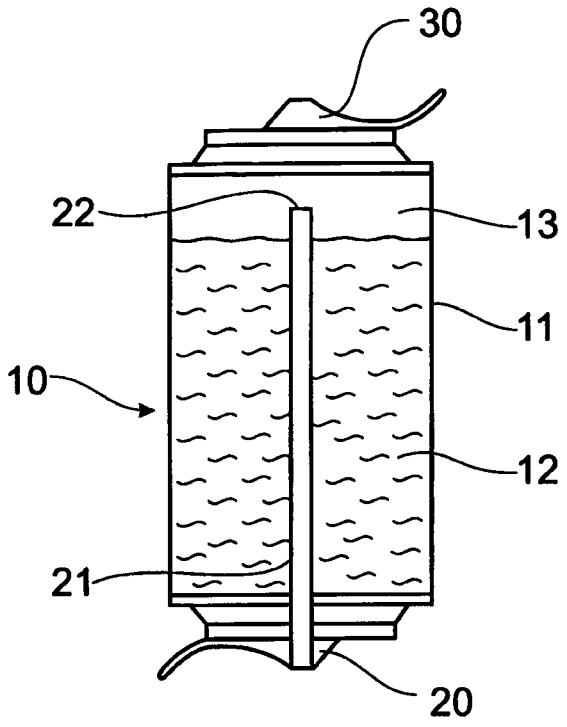
FIG. 3 shows the storage container of FIG. 2 when turned upside down.

FIG. 3 shows the storage container 10 of FIG. 2 when turned upside down i.e. the second end of storage container 10 and hence second actuator 30 are positioned to be vertically above the first end and first actuator 20. The inversion of storage container 10 prior to activation may be a component of the method of controlling the rate of inflation of a borehole plug, in accordance with the present invention. In contrast to the situation described for FIG. 2 it will now be apparent that both the open end 22 of dip tube 21 attached to the first release valve of first actuator 20 and the entrance into the second release valve of second actuator 30 open up into headspace 13 i.e. neither is in direct contact with the liquid portion of inflation fluid 12. This means that, if either of first and second actuators, 20 and 30 respectively, are activated then, initially, only vapour will be dispensed until only liquid inflation fluid 12 remains at which point this too will be expelled. This causes a quantifiable time delay effect for the inflation of the associated borehole plug.

The embodiment shown in FIG. 3 provides for three potentially different rates of release of inflation fluid 12, and hence rates of inflation of an associated borehole plug. A user may activate both first and second actuators, 20 and 30 respectively, at approximately the same time and so vapour from headspace 13 will simultaneously be expelled from the release valves of each of said first and second actuators, 20 and 30. Eventually, once the vapour has been expelled, liquid inflation fluid 12 will also be released to thereby complete inflation of the associated borehole plug. This results in a third rate of release of inflation fluid 12 and a corresponding third rate of inflation of an associated inflatable borehole plug. The third rate of release/inflation is less than/slower than the second rate of release/inflation due to the time delay effect achieved by orienting storage container 10 such that open end 22 of dip tube 21 and the intake to the second release valve of second actuator 30 open into headspace 13. In one general embodiment, for a bag of dimensions as described for the first inflation rate, the third rate of inflation may be between 45 to 70 seconds, preferably about 60 seconds.

If a user activates only first actuator 20 then a fourth rate of release of inflation fluid 12 and a corresponding fourth rate of inflation of an associated borehole plug is achieved. Since inflation fluid 12 is only being dispensed through the first release valve the fourth rate of release/inflation will be less than/slower than the third rate of release/inflation. In one general embodiment, for a bag of dimensions as described for the first inflation rate, the fourth rate of inflation may be between 70 to 100 seconds, preferably about 80 seconds.

It will be appreciated that a user may also choose to only activate second actuator 30, when in the orientation shown in FIG. 3 but, in practice, the rate of inflation of the associated borehole plug achieved would not differ by a useful amount from the fourth inflation rate and so the fourth inflation rate may be achieved, in the orientation shown in FIG. 3, by solely activating either of the first or second actuators, 20 and 30, respectively.

Although, as mentioned above, the actual times of each rate may vary depending on the factors mentioned it will be appreciated that the inflation fluid 12 release rates and the borehole plug inflation rates will always be in the relative order given i.e. first to second to third to fourth, in terms of the fastest rate to the slowest rate of release/inflation.

Figure 4:
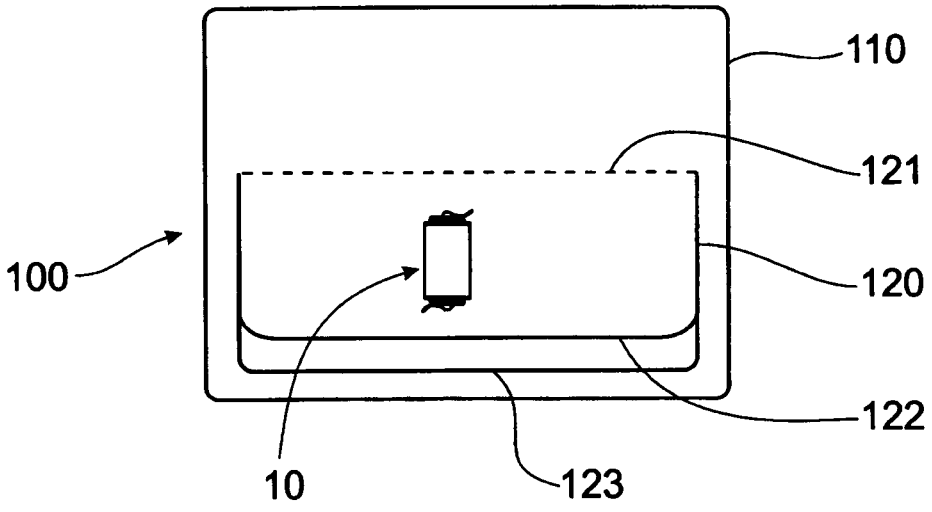
FIG. 4 shows one embodiment of an inflatable borehole plug containing the storage container of FIG. 1.

FIG. 4 shows one embodiment of an inflatable borehole plug 100 containing the storage container 10 of FIG. 1. Inflatable borehole plug 100, as shown in FIG. 4, is formed with an optional protective outer bag 110 acting as a protective sheet material suited to engagement with the walls of a borehole, as protection for an inner inflatable fluid tight bag 120, particularly as it is lowered into place in a borehole. Storage container 10 is encapsulated within inner bag 120. The outer protective bag 110 might simply be a facing sheet or sheets. Ideally, the outer protective sheet material is formed as an outer enclosing bag 110 to protect the inner fluid tight bag 120.

Outer bag 110 may be constructed from one sheet of material and stitched, adhered, heat sealed or otherwise affixed along a seam. Inner fluid tight bag 120 may be constructed in a similar manner.

Outer bag 110 may be constructed from a tough puncture resistant material such as a woven polypropylene fabric. Other suitable materials may include polymeric films; knitted, woven or non-woven fabrics of polymeric materials such as polyolefins, polyesters, polyamides and polyurethanes; glass fibre, carbon fibre, KEVLAR™ or like high tensile fibres; natural fibres such as cotton, jute, hemp and the like or mixtures thereof.

Preferably, outer bag 110 is made from a high tensile polypropylene or similar polymeric material and additionally is provided with an anti-static coating.

Fluid tight inner bag 120 may be made from a waterproof material and may be formed by a heat welding process from a polyethylene, polypropylene, nylon film or a co-extrusion such as nylon/surlyn or polyethylene/nylon/polyethylene or may be manufactured from a range of materials including a seam welded bag fabricated from a laminate of films of Nylon or Nylon copolymers with an m-LLDPE sealant film.

Preferably, inner bag 120 is formed from PET (polyethylene terephthalate) film alone or in coextrusion or laminate with one or more other polymeric materials. One preferred material for the construction of inner bag 120 is barrier film material employed in the food industry. This is a well known coextruded moisture and air resistant polymer material.

In the embodiment shown in FIG. 4 inner bag 120 is dimensioned to be slightly smaller than outer bag 110 such that it fits inside outer bag 110 but is still capable of exerting sufficient force, when fully inflated, against the inner walls of outer bag 110 to cause them to engage the walls of the borehole. Inner bag 120 has, however, in the embodiment shown, been folded over along fold line 121 shown in broken line format. Fold line 121 is formed more than halfway and, preferably, approximately five eights of the way along the length of inner bag 120. This fold results in a first edge of inner bag 122 and a second edge of inner bag 123. It has been found that providing a fold along inner bag 120 causes that portion of the folded inner bag 120 containing storage container 10 to inflate preferentially, and hence more rapidly, since the remainder of the internal volume of inner bag 120 is temporarily unavailable until the pressure in the inflating portion is such that the fold is overcome and inner bag 120 expands to its full dimensions.

This effect results in the portion of inner bag 120 containing storage container 10 inflating to such an extent that it causes outer bag 110, in the adjacent region, to engage with at least two of the borehole walls. When the full volume of inner bag 120 then comes into play the pressure is still sufficient to ensure engagement is maintained. The folding of inner bag 120 thus lessens the time taken from activation of one or more of first and second actuators, 20 and 30 respectively, to engagement with the borehole walls and thus provides for a further element of control in the present method.

Although not shown in FIG. 4, outer bag 110 may be provided with one or more tags, adapted with an eyelet or like means, by which inflatable borehole plug 100 might be suspended, in the chosen orientation of FIG. 2 or FIG. 3, during lowering into boreholes. Outer bag 110 may also be provided with suitable markings to indicate to a user which orientation storage container 10 needs to adopt and which, or both, of first and second actuators, 20 and 30 respectively, should be activated to provide for a particular desired inflation rate. For example, to achieve the fastest rate of inflation, borehole plug 100 should be oriented and lowered into the borehole with storage container 10 in a substantially vertical position with first actuator 20 uppermost and both first and second actuators, 20 and 30 respectively, activated more or less simultaneously.

It will be appreciated that variations on the apparatus and methods described herein may occur without departing from the spirit of the invention. For example, storage container 10 shown in FIGS. 2 and 3 may be provided with a second stem or dip tube of similar design and length to dip tube 21, connected with the release valve of second actuator 30. This would provide a useful albeit less preferred design to that described previously as it limits the control of the rate of inflation of the associated borehole plug 100 to simply either activating the first or second actuator, 20 and 30 respectively, or activating both. In other words the variation achieved by inverting storage container 10 would not be possible unless the stem connected to second actuator 30 was short enough to end in headspace 13, when second actuator 30 is uppermost.

A useful method of locating a borehole plug at a desired depth in a borehole is also provided for using the inflatable borehole plug as hereinbefore described and employing the activation options discussed in relation to the method controlling the rate of inflation of said borehole. This method provides for greater flexibility in choosing how quickly the borehole plug will lodge within the borehole and therefore allows the user to tailor the inflation rate to the particular decking depths required within each borehole. This limits wasted labour hours in suspending the borehole plug until it lodges or having to tie it off to a stake or the like to avoid the same issue.

The method of locating a borehole plug at a desired depth in a borehole is achieved by steps previously described in greater detail but generally including; providing an inflatable fluid tight bag having a storage container located therein, the storage container containing an inflation fluid in a compressed state and having a first actuator and a second actuator for release of the inflation fluid into the fluid tight bag; vertically orienting the storage container such that either of the first actuator or the second actuator is uppermost relative to the other; activating one or both of the first actuator and the second actuator to release the inflation fluid and initiate inflation of the fluid tight bag; locating the fluid tight bag at the desired depth in the borehole; maintaining the fluid tight bag at the desired depth in the borehole until the fluid tight bag inflates to a sufficient degree to engage with the walls of the borehole; and wherein the selection of which of the first actuator or second actuator are vertically uppermost and which are activated determines the rate of inflation of the fluid tight bag. Further steps are provided using the earlier described inflatable borehole plug and the method of controlling the rate of inflation of same.

The present invention provides for an apparatus and method to control the expulsion of inflation fluid from a pressurised container and, thus, to control the rate of inflation of a borehole plug. Explosive loads often need to be placed at different depths within either the same or different boreholes. Thus, if a pressurised container with a single release rate is employed it is necessary to ensure that the overall inflation rate of the borehole plug containing same is slow enough to allow placement at the greatest depth desired. This means that when placing a borehole plug at a lesser depth it is required that, after lowering the plug to the desired depth, the user must simply wait while holding the plug until it is sufficiently inflated to engage with the borehole walls. This is not only frustrating for the user but is a substantial waste of labour and so increases operational costs.

The present invention provides for a single design of storage container and associated borehole plug which, in turn, provides for a useful range of borehole plug inflation rates. A user need simply judge the time it will take to lower the borehole plug to the desired depth, which would be a simple matter to someone experienced in borehole plug placement, and, based on this, choose which of the four inflation rates provided would be most appropriate. For example, for relatively shallow placements the fastest inflation rate achieved by having first actuator 20 positioned vertically above second actuator 30 and activating both first and second actuators, 20 and 30 respectively, may be most appropriate to minimise the time taken by a user to successfully place the borehole plug 100. The 'dead time' whereby, with prior art devices, the operator would have to wait for a substantial length of time simply maintaining the borehole plug at the appropriate depth until the plug frictionally engaged with the borehole wall (following complete expansion of the fluid tight bag) has thus been avoided.

Further, the use of a fold over in the inner fluid tight bag 120 provides an additional advantage. The portion of inner bag 120 in which storage container 10 sits will expand more rapidly due to the temporarily decreased volume, as described. This means that the operator can feel the engagement of the borehole plug at an earlier point in time than would otherwise have been possible and can immediately leave that borehole and move onto the next one thereby providing substantial savings in man hours to deck an area containing a number of boreholes. While the operator is undertaking preparation to lower a further borehole plug into another borehole the first plug will eventually have increased its internal pressure such that the entire inner bag unfolds and thus the full available surface area of the outer bag will eventually engage with the borehole wall to provide a stronger engagement. The operator, though, is not required to be attentive to the device while this part of the operation is occurring. It will be appreciated that other alterations to the inner bag such as rolling up, folding in a different manner to that shown, or employing elastic bands or other temporary fastening means designed to rupture at a certain pressure to secure the inner bag and temporarily reduce its volume, may all be suitable.

Throughout the specification the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

The invention claimed is:

1. An inflatable borehole plug comprising:

(a) an inflatable fluid tight bag;

(b) a storage container located within the fluid tight bag, the storage container containing an inflation fluid in a compressed state and having a first actuator located on a first end thereof and a second actuator located on a second end thereof; and wherein, the first actuator is associated with a first release valve and the second actuator is associated with a second release valve, said first and second release valves are actuable to allow the inflation fluid to pass through the storage container and effect expansion of the fluid tight bag.

2. The inflatable borehole plug of claim 1 wherein the first release valve is in fluid communication with an elongate dip tube, the dip tube extending into and having an open end in fluid communication with, an interior of the storage container.

3. The inflatable borehole plug of claim 2 wherein, when the storage container is oriented such that the first actuator is positioned substantially vertically above the second actuator, the dip tube extends into the interior of the storage container such that the open end of the dip tube is immersed in a liquid portion of the inflation fluid.

4. The inflatable borehole plug of claim 3 wherein the dip tube extends into the interior of the storage container such that the open end of the dip tube is located closer to the second end of the storage container than to the first end.

5. The inflatable borehole plug of claim 4 wherein the dip tube extends into the interior of the storage container such that the open end of the dip tube is substantially adjacent the second end of the storage container.

6. The inflatable borehole plug of claim 1 wherein the second release valve does not have an associated elongate dip tube which extends substantially into the interior of the storage container.

7. The inflatable borehole plug of claim 1 wherein the first and second ends of the storage container are located opposite one another.

8. The inflatable borehole plug of claim 1 wherein the fluid tight bag is enclosed within a protective outer bag.

9. The inflatable borehole plug of claim 8 wherein the fluid tight bag is folded over within the outer bag.

10. The inflatable borehole plug of claim 1 wherein selection of activation of either one or both of the first and second actuators provides a different rate of inflation of the fluid tight bag.

11. A method of controlling the rate of inflation of an inflatable borehole plug including the steps of:

(a) providing an inflatable fluid tight bag having a storage container located therein, the storage container containing an inflation fluid in a compressed state and the storage container having a first actuator and a second actuator for release of the inflation fluid into the fluid tight bag; and (b) activating one or both of the first actuator and the second actuator to thereby control the rate of inflation of the borehole plug.

12. The method of claim 11 further including the step of orienting the storage container prior to activation such that either the first actuator or second actuator is above the other to provide access to differing rates of inflation.

13. The method of claim 12 wherein the storage container is oriented substantially vertically such that one of the first actuator and the second actuator is positioned substantially vertically above the other.

14. The method of claim 12 wherein when the storage container is oriented with the first actuator substantially vertically above the second actuator and both the first and second actuators are activated, a first rate of inflation is provided.

15. The method claim 14 wherein when the storage container is oriented with the first actuator substantially vertically above the second actuator and one of the first and second actuators is activated, a second rate of inflation is provided wherein the first rate of inflation is greater than the second rate of inflation.

16. The method of claim 15 wherein when the storage container is oriented with the second actuator substantially vertically above the first actuator and both the first and second actuators are activated, a third rate of inflation is provided, wherein the second rate of inflation is greater than the third rate of inflation.

17. The method of claim 16 wherein when the storage container is oriented with the second actuator substantially vertically above the first actuator and one of the first and second actuators is activated, a fourth rate of inflation is provided wherein the third rate of inflation is greater than the fourth rate of inflation.

18. The method of claim 11 further providing for at least two differing inflation rates.

19. The method of claim 11 further providing for at least four differing inflation rates.

20. The method of claim 11 further including the step of enclosing the fluid tight bag within a protective outer bag and folding the fluid tight bag prior to the enclosure of the fluid tight bag within the outer bag.

* * * * *